United States Patent [19]

Peck et al.

[11] Patent Number: 4,808,298

[45] Date of Patent: Feb. 28, 1989

[54] PROCESS FOR REDUCING RESID HYDROTREATING SOLIDS IN A FRACTIONATOR

[75] Inventors: Lawrence B. Peck, Houston, Tex.; Robert D. Buttke, Lisle, Ill.; George L. Ott, Naperville, Ill.; Jeffry A. Cox, Warrenville, Ill.

[73] Assignee: Amoco Corporation, Chicago, Ill.

[21] Appl. No.: 88,674

[22] Filed: Aug. 24, 1987

Related U.S. Application Data

[63] Continuation-in-part of Ser. No. 877,283, Jun. 23, 1986, abandoned.

[51] Int. Cl.[4] ..... C10G 7/00; C10G 45/16

[52] U.S. Cl. ..... 208/212; 208/48 AA; 208/100; 208/108; 208/112; 208/162; 208/177; 208/348

[58] Field of Search ..... 208/177, 157, 112, 95, 208/100, 102, 108, 145, 57, 162, 97, 348, 48 AA, 212, 254 H, 251 H; 210/728, 730; 203/6

[56] References Cited

U.S. PATENT DOCUMENTS

| | | | |
|---|---|---|---|
| 2,360,272 | 10/1944 | Plummer | 208/15 |
| 2,755,229 | 7/1956 | Beuther et al. | 208/15 |
| 2,879,224 | 3/1959 | Lawson | 208/100 |
| 3,635,815 | 1/1972 | Kuchar | 208/95 |
| 3,796,653 | 3/1974 | Gatsis | 208/95 |
| 3,948,756 | 4/1976 | Wolk et al. | 208/57 |
| 4,040,958 | 8/1977 | Rammler | 210/73 R |
| 4,082,648 | 4/1978 | Murphy | 208/97 |
| 4,137,149 | 1/1979 | Allan et al. | 208/157 |
| 4,158,622 | 6/1979 | Schwarzenbek | 208/177 |
| 4,176,048 | 11/1979 | Corns et al. | 208/59 |
| 4,285,804 | 8/1981 | Jacquin et al. | 208/112 |
| 4,302,323 | 11/1981 | Chen | 208/89 |
| 4,381,987 | 5/1983 | Kuehler | 208/419 |
| 4,391,700 | 7/1983 | Billon et al. | 208/97 |
| 4,434,045 | 2/1984 | Vernon et al. | 208/56 |
| 4,439,309 | 3/1984 | Greene et al. | 208/56 |
| 4,446,002 | 5/1984 | Siegmund | 208/48 AA |
| 4,457,830 | 7/1984 | Kydd | 208/108 |
| 4,457,831 | 7/1984 | Gendler | 208/157 |
| 4,521,295 | 6/1985 | Chervenak et al. | 208/102 |
| 4,525,267 | 6/1985 | Inooka | 208/112 |

*Primary Examiner*—Anthony McFarlane

*Attorney, Agent, or Firm*—Thomas W. Tolpin; William H. Magidson; Ralph C. Medhurst

[57] ABSTRACT

An effective hydrotreating process is provided to minimize precipitation of asphaltenic solids in the product oil. In the preferred process, an aromatic diluent, preferably comprising decanted oil, is injected into one or more of the fractionators downstream of the reactor.

8 Claims, 5 Drawing Sheets

FRESH
CATALYST
108
LIQUID LEVEL
124
PRODUCTS
OIL + $H_2$ RICH GAS
120
EXPANDED
CATALYST
BED LEVEL
70
SETTLED
CATALYST
BED LEVEL
112
122
114
110
116
126
SPENT
CATALYST
76
118
REACTANTS
OIL +
$H_2$ RICH GAS

PROCESS FOR REDUCING RESID HYDROTREATING SOLIDS IN A FRACTIONATOR

CROSS-REFERENCE TO RELATED APPLICATION

This application is a continuation-in-part of the application of Robert D. Buffke, Lawrence B. Peck, Jeffrey A. Cox, and George L. Ott, Ser. No. 877,283, filed June 23, 1986, now abandoned, entitled: Reducing Resid Hydrotreating Solids.

BACKGROUND OF THE INVENTION

This invention relates to resid hydrotreating and, more particularly, to a process for minimizing solids formed during resid hydrotreating.

In the past, spiraling oil costs, extensive price fluctuations, and artificial output limitations by the cartel of oil producing countries (OPEC) have created instability and uncertainty for net oil consuming countries, such as the United States, to attain adequate supplied of high-quality, low-sulfur, petroleum crude oil (sweet crude) from Norway, Nigeria, and other countries at reasonable prices for conversion into gasoline, fuel oil, and petrochemical feedstocks. In an effort to stabilize the supply and availability of crude oil at reasonable prices, Amoco Oil Company has developed, constructed, and commercialized extensive, multimillion dollar refinery projects under the Second Crude Replacement Program (CRP II) to process poorer quality, high-sulfur, petroleum crude oil (sour crude) and demetallate, desulfurize, and hydrocrack resid to produce high-value products, such as gasoline, distillates, catalytic cracker feed, metallurgical coke, and petrochemical feedstocks. The Crude Replacement Program is of great benefit to the oil consuming nations by providing for availability of adequate supplies of gasoline and other petroleum products at reasonable prices while protecting the downstream operations of refining companies.

During resid hydrotreating, such as under Amoco Oil Company's Crude Replacement Program, resid oil is upgraded with hydrogen and a hydrotreating catalyst to produce more valuable lower-boiling liquid products. Undesirably, carbonaceous solids are formed, however, during resid hydrotreating. These solids have been characterized as multicondensed aromatics which form and precipitate from cracking of the side chains of asphaltenes. Asphaltenic solids are substantially insoluble in hexane, pentane, and in the effluent hydrotreated product oil. The solids become entrained and are carried away with the product.

Alphaltenic solids tend to stick together, adhere to the sides of vessels, grow bigger, and agglomerate. Asphaltenes are more polar and less soluble than the residual oil feedstock.

Asphaltenic carbonaceous solids are produced as a reaction by-product during fixed bed hydrotreating, hydrovisbreaking, and ebullated bed hydrotreating (expanded bed hydrotreating). During ebullated bed hydrotreating, the ebullating hydrotreating catalyst fines serve as a nucleus and center for asphaltene growth. The situation becomes even more aggravated when two or more hydrotreating reactions are connected in series as in many commercial operations. In such cases, solids formed in the first reactor not only form nucleation sites for solids growth and agglomeration in the first reactor, but are carried over with the hydrotreated product oil into the second reactor, etc., for even larger solids growth and agglomeration.

The concentration of carbonaceous solids increases at more severe hydrotreating conditions, at higher temperatures and at higher resid conversion levels. The amount of carbonaceous solids is dependent on the type of feed. Resid conversion is limited by the formation of carbonaceous solids.

Solids formed during reside hydrotreating cause deposition and poor flow patterns in the reactors, as well as fouling, plugging, and blocking of conduits and downstream equipment. Oils laden with solids cannot be efficiently or readily pipelined. Hydrotreating solids can abrade valves and other equipment, and can build up insulative layers on heat exchange surfaces reducing their efficiency. Buildup of hydrotreated solids can lead to equipment repair, shutdown, extended downtime, reduced process yield, decreased efficiency, and undesired coke formation.

Over the years, a variety of processes and solvents, hydrogen donors, and other fluids have been suggested for various refining operations, such as for upgrading oil or reducing hydrotreated solids. Typifying some of these prior art processes, solvents, hydrogen donors, and other fluids are those described in U.S. Pat. Nos. 2,879,224; 3,579,436; 3,681,231; 4,137,149; 4,434,045; 4,451,354; 4,525,267; 4,457,831; 4,485,004; and 4,495,060. These prior art processes, solvents, hydrogen donors, and other fluids have met with varying degrees of success.

It is, therefore, desirable to provide an improved process for minimizing solids from resid hydrotreating which overcomes most, if not all, of the above problems.

SUMMARY OF THE INVENTION

An improved process is provided to reduce formation of carbonaceous solids from resid hydrotreating, which is efficient, effective, and economical. Advantageously, the novel process accommodates higher resid conversion levels, enhances product quality, and improves product yield. Desirably, the treated low solids hydrotreated oil can be safely pipelined through valves, outlet orifices, pumps, heat exchangers, and downstream refining equipment.

The novel process decreases the frequency of repair, reduces downtime, and enhances the useful life of refining equipment. The novel process minimizes coke deposition and improves the flow patterns in the hydrotreating reactors.

The hydrotreating process of this invention is useful in fixed bed hydrotreaters, slurry bed hydrotreaters, entrained bed hydrotreaters, hydrovisbreaking, and especially in ebullated bed hydrotreaters.

In order to minimize the formation of carbonaceous solids from hydrotreating, the oil is contacted with a diluent. Preferably, the diluent comprises an aromatic diluent, such as decanted oil, heavy catalytic cycle oil, light catalytic cycle oil, hydrotreated creosote oil, raw unhydrotreated creosote oil, lube oil-aromatic extract, polymeric aromatic ultraformer oil, and combinations thereof.

As used in this Patent Application, the term "aromatic diluent" means a diluent in which 70% or more of its carbon atoms are aromatic.

The terms "resid oil" and "resid" as used in this Patent Application means residual oil.

Unexpected, surprisingly good results were obtained when the aromatic diluent added was less than 20% by weight of the influent resid oil feedstock. For improved economical and process efficiency, the aromatic diluent preferably ranges from 7% to 12% by weight of the influent reside oil feedstock.

In one form, diluent is injected directly into the hydrotreating reactors or the upstream feed lines or feed drum. This has the advantage of increased hydrogenation and hydrotreating of the resid oil and extra conversion of the diluent into more valuable products. Since some of the diluent is hydrotreated and converted into more valuable products, however, more hydrogen is needed for conversion, and more diluent may be required for solids treatment.

In another form, diluent is added downstream of the reactors, preferably into one or more fractionators comprising atmospheric tower and/or vacuum tower, or the feed lines or the discharge lines thereof. This technique has the advantage of requiring less diluent for solids treatment and less hydrogen (hydrogen-rich gases) for hydrotreating over the previously described technique. This technique also achieves better conversion and yields since the diluent doesn't occupy reactor volume. It desirably reduces production of light hydrocarbon gases and is operable at lower pressures. Advantageously, this procedure also significantly improves hydrotreating efficiency, effectiveness and economy and minimizes precipitation of asphaltenic solids in the fractionators (atmospheric tower and vacuum tower).

For improved process efficiency, effectiveness, and economy, the preferred diluent is decanted oil. In the preferred process, decanted oil is fed to both the atmospheric tower and the vacuum tower in order to achieve the desired heat balance and process efficiency.

A more detailed explanation of the invention is provided in the following description and appended claims taken in conjunction with the accompanying drawings.

DETAILED DESCRIPTION OF THE PREFERRED EMBODIMENTS

Figure 2:
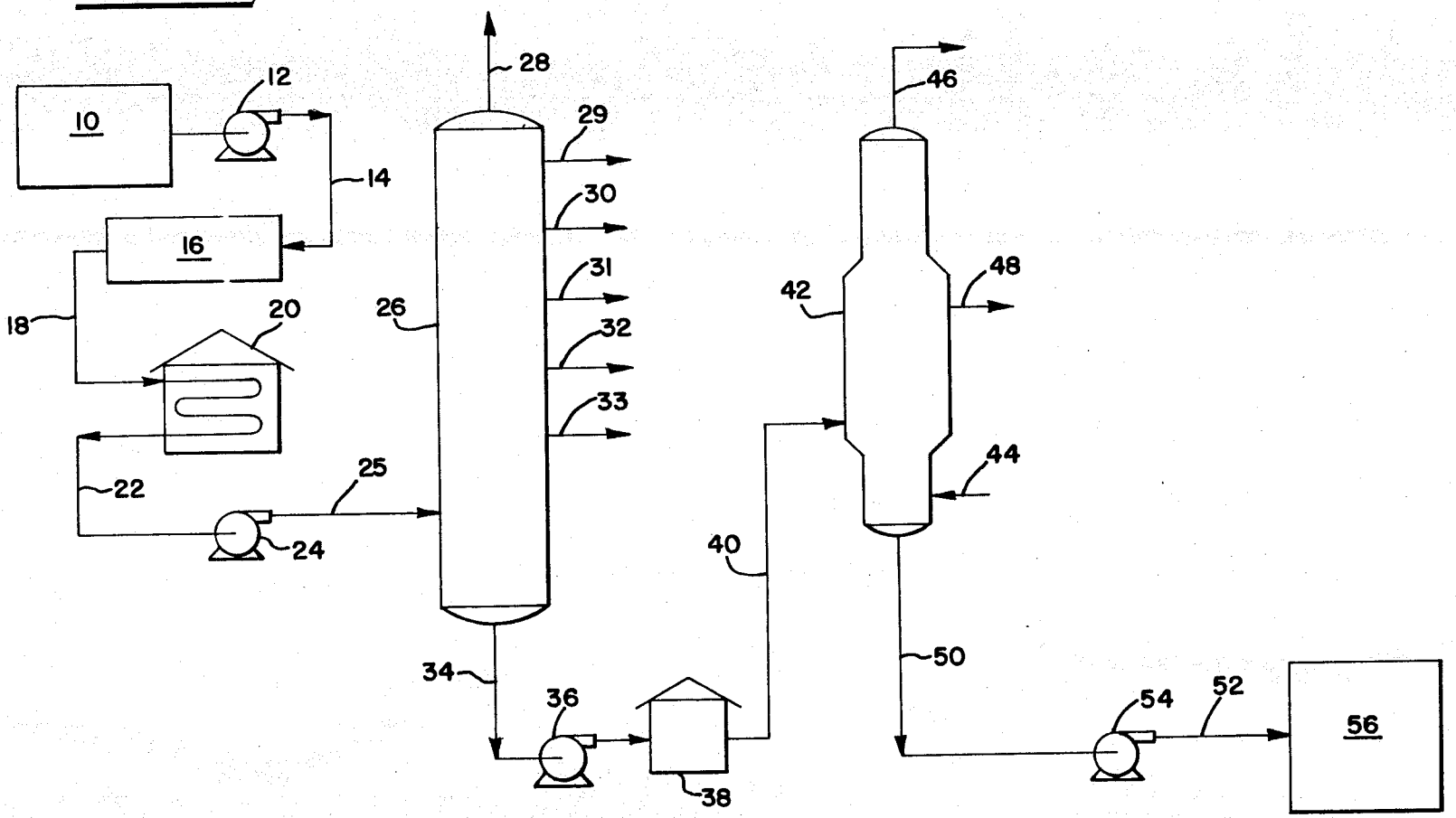
FIGS. 2–4 are schematic flow diagrams of various refining operations.

In refining (FIG. 2), crude oil (petroleum) is withdrawn from an aboveground storage tank 10 by a pump 12 and pumped through feed line 14 into one or more desalters 16 to remove particulates, such as sand, salt, and metals, from the oil. The desalted oil is fed through furnace inlet line 18 into a pipestill furnace 20 where it is heated to a temperature, such as to 750° F. at a pressure ranging from 125 to 200 psi. The heated oil is removed from the furnace through exit line 22 by a pump 24 and pumped through a feed line 25 to a primary distillation tower 26.

The heated oil enters the flash zone of the primary tower 26 before proceeding to the upper rectifier section or the lower stripper section of the primary tower. The primary tower is preferably operated at a pressure less than 60 psi. In the primary tower, the heated oil is separated into fractions of wet gas, light naphtha, intermediate naphtha, heavy naphtha, kerosene, virgin gas oil, and primary reduced crude. A portion of the wet gas, naphtha, and kerosene is preferably refluxed (recycled) back to the primary tower to enhance yield and efficiency.

Wet gas is withdrawn from the primary tower 26 through over head wet gas line 28. Light naphtha is removed from the primary tower through light naphtha line 29. Intermediate naphtha is removed from the primary tower through intermediate naphtha line 30. Heavy naphtha is withdrawn from the primary tower 26 through heavy naphtha line 31. Kerosene and oil for producing jet fuel and furnace oil are removed from the primary tower through kerosene line 32. Virgin gas oil is removed from the primary tower through virgin gas oil line 33.

Primary reduced crude is discharged from the bottom of the primary tower 26 through the primary reduced crude line 34. The primary reduced crude in line 34 is pumped by pump 36 into a furnace 38 which it is heated, such as to a temperature of about 750° F. The heated primary reduced crude is conveyed through a furnace discharge line 40 into the flash zone of a pipestill vacuum tower 42.

The vacuum tower 42 is preferably operated at a pressure ranging from 35 to 50 mm of mercury. Steam is injected into the bottom portion of the vacuum tower through steam line 44. In the vacuum tower, wet gas is withdrawn from the top of the tower through overhead wet gas line 46. Heavy gas oil is removed from the middle portion of the vacuum tower through heavy gas oil line 48. Vacuum-reduced crude is removed from the bottom of the vacuum tower through vacuum-reduced crude line 50. The vacuum-reduced crude has an initial boiling point of about 1000° F.

The vacuum-reduced crude, also referred to as resid or resid oil, is pumped through vacuum-reduced crude lines 50 and 52 by a pump 54 into a feed drum or surge drum 56. Resid oil is pumped from the surge drum through reactorfeed lines 58 and 60 (FIG. 3) by a pump 62 into resid hydrotreating units (RHU) 64, 66, and 68 (FIG. 1).

Figure 1:
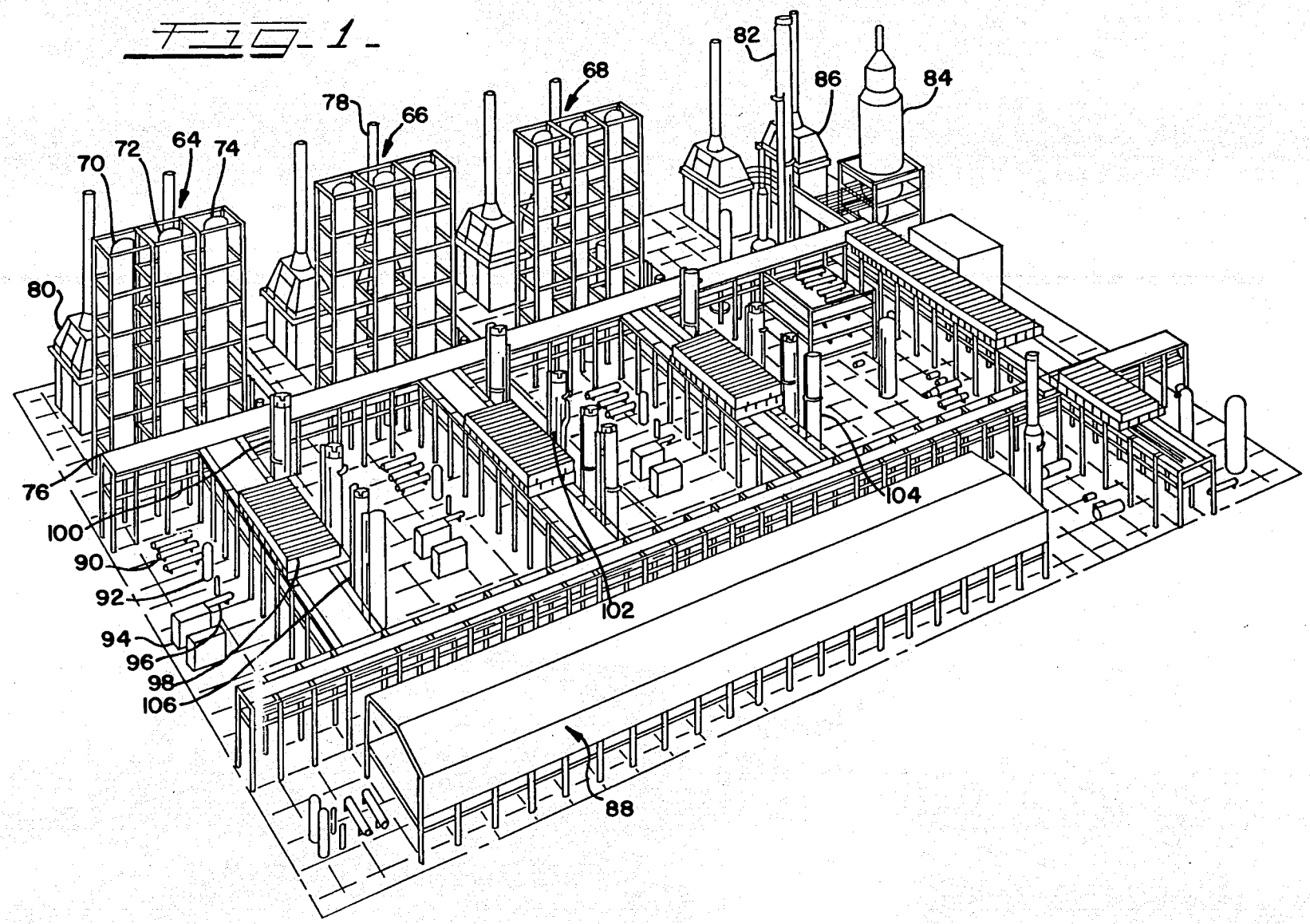
FIG. 1 is a perspective view of resid hydrotreating units and associated refinery equipment.

As shown in FIG. 1, each resid hydrotreating unit 64, 66, and 68 is a reactor train comprising a cascaded series or set of three ebullated bed reactors 70, 72, and 74. Hydrogen is injected into the ebullated bed reactors through feed line 76. A relatively high sulfur resid or sour crude is fed to the reactor where it is hydroprocessed (hydrotreated) in the presence of ebullated (expanded) fresh and/or equilibrium hydrotreating catalyst and hydrogen to produce an upgraded effluent product stream leaving spent catalyst. As used throughout this patent application, the term "equilibrium hydrotreating catalyst" means a fresh hydrotreating catalyst which has been partially or fully used. The term "spent hydrotreating catalyst" as used in this patent application comprises equilibrium hydrotreating catalyst which has been withdrawn from a hydrotreating reactor. Hydroprocessing in the RHU includes demetallation, desulfurization, hydrocracking, and removal of Rams carbon. Hydroprocessing can convert most of the feedback distillates, catalytic cracker feed, and petrochemical feedstocks. The remaining portion of the products can be charged to cokers.

The resid hydrotreating units and associated refining equipment of FIG. 1 comprise three identical parallel trains of cascaded ebullated bed reactors 70, 72, and 74, as well as hydrogen heaters 78, influent oil heaters 80, an atmospheric tower 82, a vacuum tower 84, a vacuum tower oil heater 86, a hydrogen compression area 88, oil preheater exchangers 90, separators 92, recycled gas compressors 94, flash drums 96, separators 98, raw oil surge drums 100, sponge oil flash drums 102, amine absorbers and recycle gas suction drums 104, and sponge oil absorbers and separators 106.

Each of the reactor trains comprises three ebullated bed reactors in series. The feed typically comprises resid oil and hydrogen-rich gases. The hydrogen-rich gases comprise recycle gases and hydrogen. Demetallation primarily occurs in the first ebullated bed reactor in each train. Desulfurization primarily occurs in the second and the third ebullated bed reactors in each train. The effluent product stream typically comprises light hydrocarbon gases, hydrotreated naphtha, distillates, light and heavy gas oil, and unconverted resid. The hydrotreating catalyst typically comprises a hydrogenating component on a porous refractory, inorganic oxide support.

The resid hydrotreating unit is quite flexible and, if desired, the same catalyst can be fed to one or more of the reactors or a separate demetallation catalyst can be fed to the first reactor while a desulfurization catalyst can be fed to the second and/or third reactors. Alternatively, different catalyst can be fed to each of the reactors, if desired. The used spent catalyst typically contains or is covered with nickel, sulfur, vanadium, and carbon (coke). As much as 50 tons of catalyst are transported into, out of, and replaced in the ebullated bed reactors daily.

Figure 5:
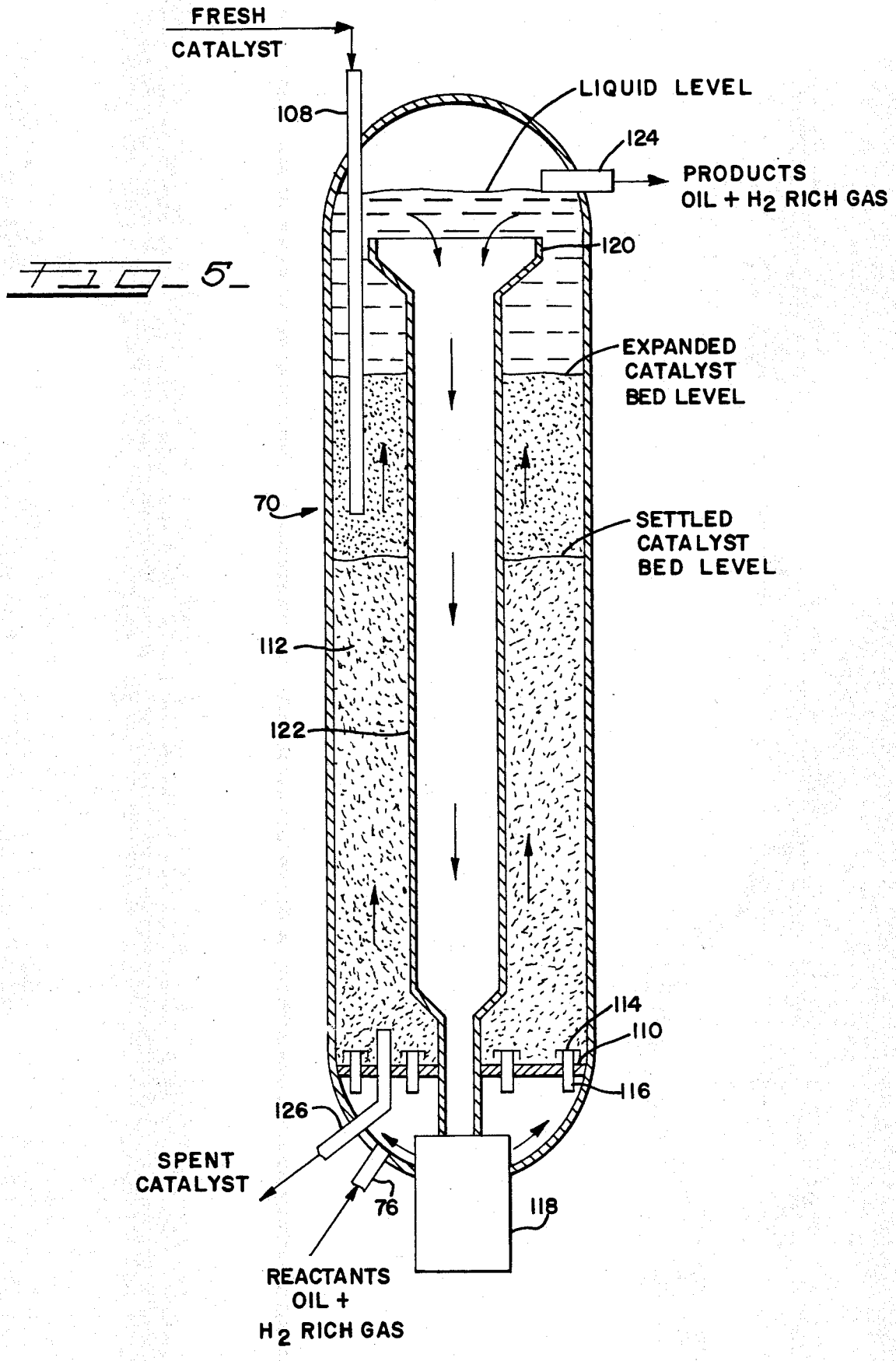
FIG. 5 is a cross-sectional view of an ebullated bed reactor.

As shown in FIG. 5, fresh hydrotreating catalyst is fed downwardly into the top of the first ebullated bed reactor 70 through the fresh catalyst feed line 108. Hot resid feed and hydrogen-rich gases enter the bottom of the first ebullated bed reactor 70 through feed line 76 and flows upwardly through a distributor plate 110 into the fresh catalyst bed 112. The distributor plate contains numerous bubble caps 114 and risers 116 which help distribute the oil and the gas across the reactor. An ebullating pump 119 circulates oil from a recycle pan 120 through a downcomer 122 and the distributor plate 110. The rate is sufficient to lift and expand the catalyst bed from its initial settled level to its steady state expanded level. The effluent product stream of partially hydrotreated oil and hydrogen-rich gases are withdrawn from the top of the reactor through effluent product line 124. The used spent catalyst is withdrawn from the bottom of the reactor through spent catalyst discharge line 126. The spent catalyst typically contains deposits of metals, such as nickel and vanadium, which have been removed from the influent feed oil during hydrotreating.

Catalyst particles are suspended in a two-phase mixture of oil and hydrogen-rich gas in the reaction zone of the reactor. Hydrogen gas typically continually bubbles through the oil. The random ebullating motion of the catalyst particle results in a turbulent mixture of the three phases which promotes good contact mixing and minimizes temperature gradients.

The cascading of the ebullated bed reactors in a series of three per reactor train, in which the effluent of one reactor serves as the feed to the next reactor, greatly improved the catalytic performance of the backmixed ebullated bed process. Increasing the catalyst replacement rate increases the average catalyst activity.

Figure 3:
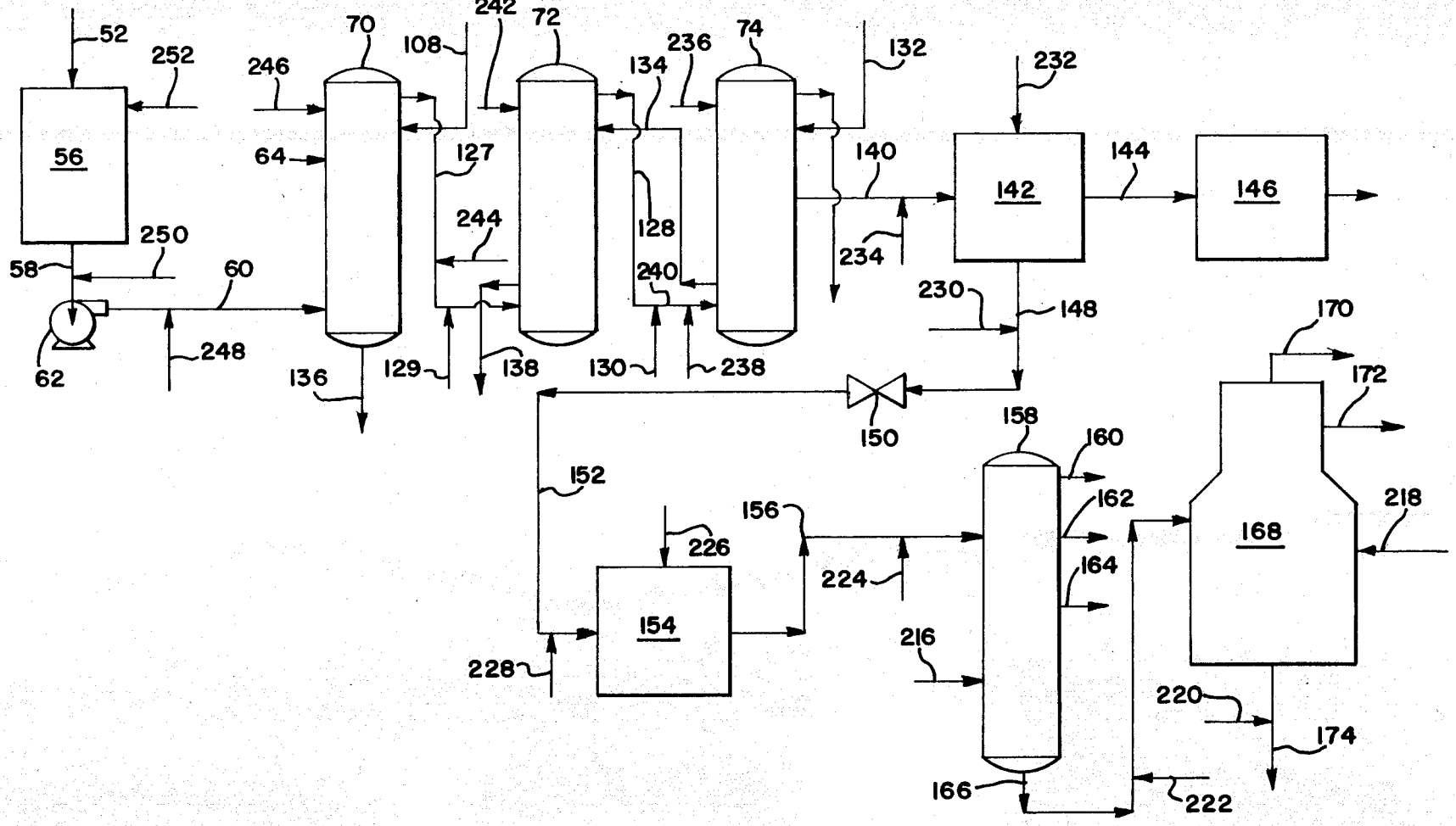

As shown in FIG. 3, the partially hydrotreated effluent in the outlet line 127 of the first ebullated bed reactor 70 comprises the influent feed of the second ebullated bed reactor 72. The partially hydrotreated effluent in the outline line 128 of the second ebullated bed reactor 72 is the influent feed of the third ebullated bed reactor 74. The second and third reactors are functionally, operatively, and structurally similar to the first reactor and cooperate with the first reactor to effectively hydrotreat and upgrade the influent feed oil. Quench liquid (oil) and/or vapor can be injected into the influent feeds of the second and third reactors through quench lines 129 and 130 to cool and control the bulk temperatures in the second and third reactors. Fresh catalyst can be fed into the top of all the reactors, although for process efficiency and economy it is preferred to utilize catalyst staging by feeding fresh catalyst into the first and third reactors through fresh catalyst feed lines 108 and 132 and by feeding recycled spent catalyst from the third reactor into the second reactor through recycle catalyst line 134. For best results, the catalyst is fed downwardly into the ebullated bed reactor in countercurrent flow relationship to the influent oil and hydrogen feed. Used spent catalyst is discharged from the reactor through spent catalyst discharge lines 136 and 138.

Preferably, resid is heated in the oil heater 80 (FIG. 1) and hydrogen-rich gases are heated in the hydrogen heater 78 before being combined and fed through the feed line 76 into the first reactor for process efficiency. The effluent product streams can be withdrawn from the bottoms or tops of the reactors, as desired.

The fluid state of the ebullated hydrotreating catalyst enhances the flexibility of the ebullated bed reactors and permits the addition or withdrawal of oil slurry and catalyst without taking the reactors offstream. Daily catalyst replacement results in a steady state equilibrium catalyst activity.

Products are withdrawn from the bottom, side, or top of the third reactor 74 and are separated into fractions of oil and gas in the towers and other processing equipment as described below.

The ebullated bed reactors are capable of handling atmospheric and vacuum resids from a wide range of sour and/or heavy crudes. Such crudes can have a gravity as much as 20° API, a sulfur content up to 85 by weight, and substantial amounts of nickel and vanadium. The ebullated bed reactors typically operates at a temperature above 700° F. and at a hydrogen partial pressure greater than 1500 PSIA.

Ebullated bed reactors have many advantages over fixed bed reactors. They permit operation at higher average temperatures. They permit the addition and withdrawal of catalyst without necessitating shutdown. They avoid plugging due to dirty feed.

Since the liquid resid feed does not usually have enough velocity to expand the catalyst bed above its settled level, liquid is recycled from the top of the reactor to the bottom of the reactor through a downcomer pipe and then pumped back up through the reactor at a sufficient velocity to attain the required degree of expansion.

The products produced from the resid hydrotreating units in the ebullated bed reactors include light hydrocarbon gases, light naphtha, heavy naphtha, light distillate, mid-distillate, diesel oil, light vacuum gas oil, heavy vacuum gas oil, and 1000+° F. resid. The light hydrocarbon gases and light naphtha can be fed into a vapor recovery unit.l Heavy naphtha can be sent to a reformer. The mid-distillate oil is useful for producing diesel fuel and furnace oil, as well as for conveying and/or cooling the spend catalyst. Light and heavy vacuum gas oils are useful as feedstock for a catalystic cracker. The 1000+° F. resid can be sent to cokers to produce coke.

During hydrotreating, resid oil and hydrogen-rich gases are ebullated, mixed, hydroprocessed, and hydrotreated in the presence of the ebullated hydrotreating catalyst under ebullated hydrotreating conditions to produce hydrotreated oil containing carbonaceous solids. The solids range in size from less than 0.03 microns to several thousand microns. The solids have been characterized as asphaltenic and are sticky, cohesive, and agglomerate.

As shown in FIG. 3, the effluent product stream of hydrotreated resid oil containing entrained particulates of carbonaceous asphaltenic solids are discharged from the third reactor 74 of the resid hydrotreating unit through an outlet or discharge line 140 and conveyed to a high pressure separator 142. The hydrotreated oil effluent output from the third reactor typically has a density ranging from about 20° to 25° API. In the high pressure separator, the hydrotreated oil is separated into a solids-free or low solids stream of light hydrotreated oil and a solids-enriched stream of heavy hydrotreated oil containing a greater concentration of the carbonaceous asphaltenic solids than the effluent product stream of hydrotreated oil. The low solid stream of light hydrotreated oil is discharged from the high pressure separator through a light oil line 144 to downstream upgrading equipment 146 for further fractionation and upgrading. The solids-laden stream of heavy oil is discharged from the bottom of the high pressure separator through a heavy oil line 148. The pressure of the high pressure heavy oil is reduced by a pressure reduction valve 150 and conveyed through a low pressure 152 line into an optional stripper or stripper vessel 154. The stripped, heavy hydrotreated oil is conveyed through atmospheric tower-inlet line 156 and fed into an atmospheric tower 158.

In the atmospheric tower 158 (FIG. 3), the hydrotreated heavy oil is separated into an atmospheric stream of light distillates, an atmospheric stream of heavy distillates, an atmospheric stream of light gas oil, and an effluent stream of atmospheric resid oil or heavy naphtha containing a greater concentration of carbonaceous solids than the heavy hydrotreated oil in the atmospheric towerinlet line. Light distillates are withdrawn from the atmospheric tower through a light distillate line 160. Heavy distillates are withdrawn from the atmospheric tower through a heavy distillage line 162. Gas oils are withdrawn from the atmospheric tower through a gas oil line 164. Atmospheric resid oil is discharged from the bottom of the atmospheric tower through an atmospheric resid line 166 and conveyed to a vacuum tower 168.

In the vacuum tower 168 (FIG. 3), the atmospheric effluent, hydrotreated resid oil (heavy naphtha) is separated into light vacuum gas oil (LVGO), heavy vacuum gas oil (HVGO), and vacuum resid oil or vacuum resid. LVGO is withdrawn from the vacuum tower through an overhead light vacuum gas oil line 170. HVGO is withdrawn from the vacuum tower through a heavy vacuum gas oil line 172. HVGO can be used to cool the spent hydrotreating catalyst. Vacuum resid oil is withdrawn from the bottom of the vacuum tower through a vacuum resid discharge line 174 and fed to a coker or used for fuel oil products.

Figure 4:
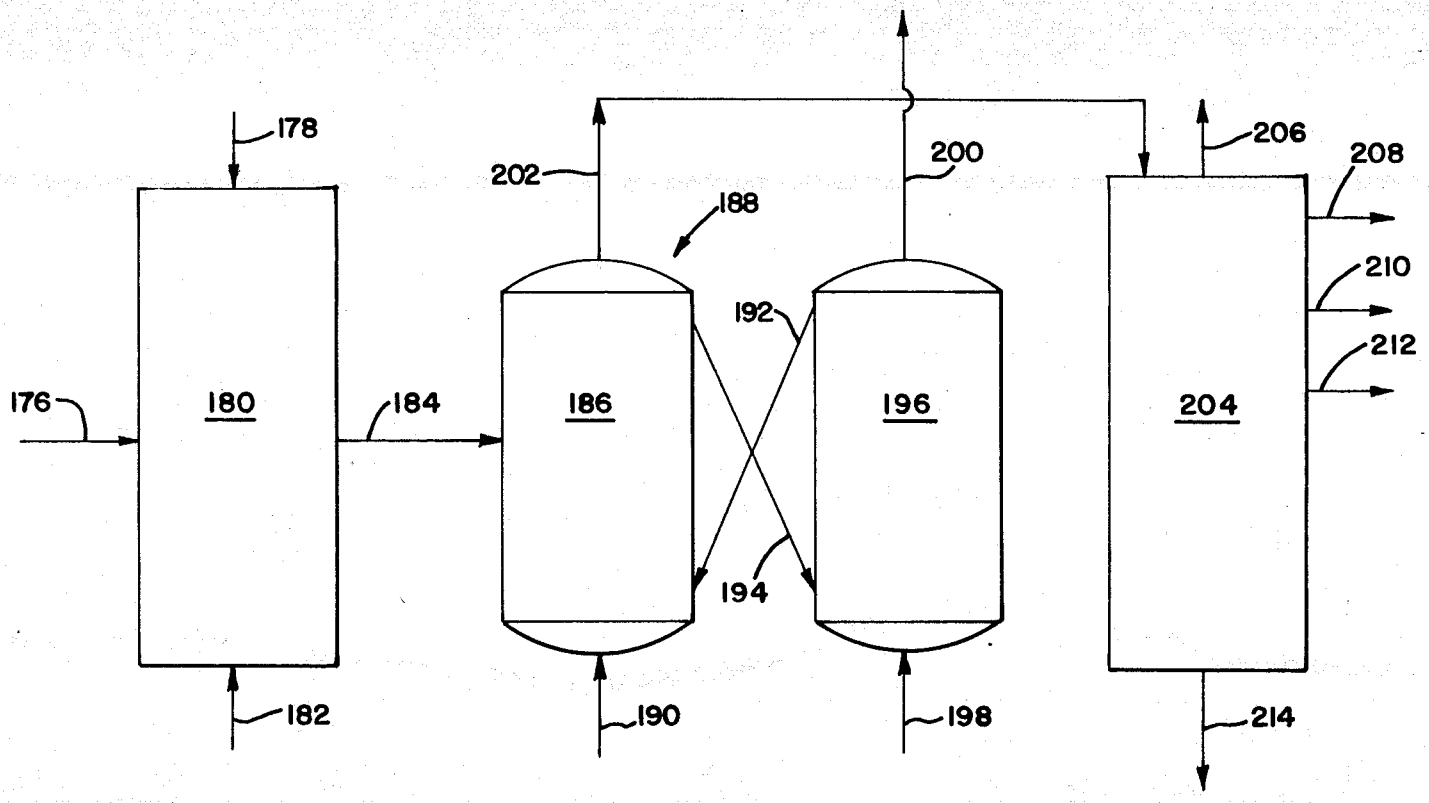

Elsewhere in the refinery, light vacuum gas oil from the light vacuum gas oil line 170 and/or heavy vacuum gas oil from the heavy vacuum gas oil lines 172 or 48 are conveyed through inlet conduit 176 or 178 (FIG. 4) into an optional catalytic feed hydrotreater 180 where it is hydrotreated with hydrogen from hydrogen feed line 182 in the presence of a hydrotreating catalyst. The hydrotreated gas oil is discharged through a discharge line 184 where it is fed and conveyed into the bottom of a catalytic cracking reactor 186, such as the reactor of a fluid catalytic cracker (FCC) unit 188. Fresh makeup catalytic cracking catalyst and regenerated catalytic cracking catalyst are fed into the reactor through fresh makeup catalyst line 190 and regenerated catalyst line 192, respectively. In the FCC reactor, the hydrocarbon feedstock is vaporized upon being mixed with the hot cracking catalyst and the feedstock is catalytically cracked to more valuable, lower molecular weight hydrocarbons.

Spent catalyst containing deactivating deposits of coke is discharged from the FCC reactor 186 (FIG. 4) through spent catalyst line 194 and fed to the bottom portion of an upright, fluidized catalyst regenerator or combustor 196. The reactor and regenerator together provide the primary components of the catalytic cracking unit. Air is injected upwardly into the bottom portion of the regenerator through an air injector line 198. The air is injected at a pressure and flow rate to fluidize the spent catalyst particles generally upwardly within the regenerator. Residual carbon (coke) contained on the catalyst particles is substantially completely combusted in the regenerator leaving regenerated catalyst for use in the reactor. The regenerated catalyst is discharged from the regenerator through regenerated catalyst line 192 and fed to the reactor. The combustion off-gases (flue gases) are withdrawn from the top of the combustor through an overhead combustion off-gas line or flue gas line 200.

Suitable cracking catalysts include, but are not limited to, those containing silica and/or alumina, including the acidic type. The cracking catalyst may contain other refractory metal oxides such as magnesia or zirconia. Preferred cracking catalysts are those containing crystalline aluminosilicates, zeolites, or molecular sieves in an amount sufficient to materially increase the cracking activity of the catalyst, e.g., between about 1 and about 25% by weight. The crystalline aluminosilicates can have silica-to-alumina mole ratios of at least about 2:1, such as from about 2 to 12:1, preferably about 4 to 6:1 for best results. The crystalline aluminosilicates are usually available or made in sodium form and this component is preferably reduced, for instance, to less than about 4 or even less than about 1% by weight through exchange with hydrogen ions, hydrogen-precursors such as ammonium ions, or polyvalent metal ions. Suitable polyvalent metals include calcium, strontium, barium, and the rare earth metals such as cerium, lanthanum, neodymium, and/or naturally-occurring mixtures of the rare earth metals. Such crystalline materials are able to maintain their pore structure under the high temperature conditions of catalyst manufacture, hydrocarbon processing, and catalyst regeneration. The crystalline aluminosilicates often have a uniform pore structure of exceedingly small size with the cross-sectional diameter of the pores being in a size range of about 6 to 20 angstroms, preferably about 10 to 15 angstroms. Silica-alumina based cracking catalysts having a major proportion of silica, e.g., about 60 to 90 weight percent silica and about 10 to 40 weight percent alumina, are suitable for admixture with the crystalline aluminosilicate or for use as such as the cracking catalyst. Other cracking catalysts and pore sizes can be used.

The effluent product stream of catalystically cracked hydrocarbons is withdrawn from the top of the FCC reactor 186 (FIG. 4) through an overhead product line 202 through an FCC fractionator 204. In the FCC fractionator, the catalytically cracked hydrocarbons are fractionated (separated) into light hydrocarbon gases, naphtha, light catalytic cycle oil (LCCO), heavy catalytic cycle oil (HCC)), and decanted oil (DCO). Light hydrocarbon gases are withdrawn from the FCC fractionator through a light gas line 206. Naphtha is withdrawn from the FCC fractionator through a naphtha line 208. LCCO is withdrawn from the FCC fractionator through a light catalytic cycle oil line 210. HCCO is withdrawn from the FCC fractionator through a heavy catalytic cycle oil line 212. Decanted oil is withdrawn from the bottom of the FCC fractionator through a decanted oil line 214.

In order to minimize and substantially decrease the concentration of carbonaceous asphaltenic solids formed during resid hydrotreating, the resid oil feedstock or hydrotreated oil is contacted, treated, and reacted with an aromatic diluent and solvent having a gravity ranging from −5° API to +20° API and preferably from −5° API to +10° API. Decanted oil from decanted oil line 214 (FIG. 4) is the preferred aromatic diluent because it is effective, abundant, and economical. It was unexpectedly and surprisingly found that the carbonaceous asphaltenic solids formed during resid hydrotreating were substantially reduced and that hydrotreating efficiency and effectiveness were substantially increased when the amount of aromatic diluent added to the oil ranged from about 5% to less than 20% by weight of the resid oil feedstock. Best results were attained when the amount of aromatic diluent added to the oil ranged from about 7% to about 12% by weight of the resid oil feedstock.

While decanted oil is the most effective and economical diluent and is, therefore, preferred, other aromatic diluents can be advantageously used in lieu of or in addition to decanted oil to minimize and decrease carbonaceous asphaltenic solids formed during resid hydrotreating, such as: heavy catalytic cycle oil (HCCO) from the heavy catalytic cycle oil ine 212 (FIG. 4), light catalytic cycle oil (LCCO) from the light catalytic cycle oil line 210, hydrotreated creosote oil, raw unhydrotreated creosote oil, lube oil-aromatic extract, polymeric aromatic ultraformer oil, and combinations thereof.

The amount of aromaticity of the diluent can be measured by carbon nuclear magnetic residence (NMR). It was found that diluents having less than 60% to 65% aromatics have little effect in decreasing the amount and concentration of carbonaceous solids, while diluents having at least 80% aromatics have a substantial beneficial effect in decreasing the amount and concentration of carbonaceous solids. The aromatic diluents preferably have a boiling point above 500° F. so that the diluent remains in a liquid phase in the resid hydrotreating reactors and downstream lines and equipment.

In the preferred embodiment, the aromatic diluent comprises decanted oil which is injected directly into the atmospheric tower 158 (FIG. 3) through an atmospheric tower-diluent injection line 216 and directly into the vacuum tower 168 through a vacuum tower-diluent injection line 218. It has been found that this arrangement greatly improves the overall economy of the process, while achieving the desired reduction of RHU carbonaceous asphaltenic solids at the desired heat balance. For best results, the total amount of diluent (decanted oil) injected into the atmospheric and vacuum towers ranges from about 5% to less than 20%, and preferably from about 7% to about 12%, by weight of the influent resid oil feedstock in feed line 60 and feed drum 58. This arrangement has been tested and commercialized in the Amoco Oil Company Refinery at Texas City, Texas, and has been found to produce unexpected, surprisingly good results and has been commercially very successful. It was found that feeding (injecting) decanted oil into a fractionator (atmospheric tower and/or vacuum tower) has many disadvantages and unique results over injecting a diluent upstream or into the reactor, or at other locations:

1. Less diluent (decanted oil) is required to decrease the asphaltenic solids.
2. Less hydrogen and hydrogen-rich gases are consumed and required in the reactors.
3. Better conversion and yields are obtained since the diluent (decanted oil) doesn't occupy reactor volume.
4. Reduced production of light hydrocarbon gases.
5. Improved hydrotreating efficiency, effectiveness, and economy.
6. Minimizes precipitation of asphaltenic solids in the fractionators (atmospheric tower and vacuum tower).

The aromatic diluent can be added (injected) to the atmospheric tower 158 and/or the vacuum tower 168.

While the preceding diluent arrangement is preferred for best results, in some circumstances it may be desirable that the diluent be injected or fed through one or more of the following lines or conduits (shown in FIG. 3) with optional heat transfer equipment:

1. A vacuum resid, diluent feed line 220 connected to and communicating with the vacuum resid discharge line 174;
2. An auxiliary vacuum tower-diluent feed line 222 connected to and communicating with the atmospheric resid discharge line 166 which feeds into the vacuum tower 168;
3. An auxiliary atmospheric tower-diluent feed line 224 which is connected to and communicates with the stripper discharge line 156 which feeds into the atmospheric tower 158;
4. A stripper injection line 226 which injects diluent directly into the stripper vessel 154;
5. A low pressure-diluent injection line 228 which is connected to and communicates with the low pressure line 152;
6. A high pressure-diluent injection line 230 which is connected to and communicates with the high pressure discharge line 148;
7. A high pressure separator-diluent line 232 which feeds aromatic diluent directly into the high pressure separator 142;
8. An auxiliary inlet, high pressure-diluent feed line 234 which is connected to and communicates with the hydrotreated oil-discharged line 140 for injecting the aromatic diluent into the hydrotreated oil after it leaves the third resid hydrotreating reactor 74 and before it enters the high pressure separator 142;
9. A third resid hydrotreating reactor-diluent injector line 236 connected to and communicating with the third resid hydrotreating reactor 74 for injecting aromatic diluent directly into the third resid hydrotreating reactor;

10. An auxiliary third resid hydrotreating reactor-diluent feed line 238 connected to and communicating with the hydrotreated oil output line 240 from the second resid hydrotreating reactor 72 for injecting aromatic diluent into the hydrotreated oil from the second reactor before it enters the third resid hydrotreating reactor 74;

11. A second resid hydrotreating reactor injector line 242 connected to and communicating with the second resid hydrotreating reactor 72 for injection diluent directly into the second resid hydrotreating reactor;

12. An auxiliary resid hydrotreating second reactor-diluent feed line 244 connected to and communicating with the hydrotreated oil output line 127 from the second resid hydrotreating reactor for injecting aromatic diluent into the hydrotreated oil effluent from the first resid hydrotreating reactor 70 before it enters the second reactor 72;

13. A first resid hydrotreating reactor-diluent injector line 246 connected to and communicating with the first resid hydrotreating reactor 70 for injecting aromatic diluent directly into the first resid hydrotreating reactor;

14. An auxiliary first reactor-diluent feed line 248 connected to and communicating with the first reactor-feed line 60 for feeding aromatic diluent into the influent resid oil feedstock before it enters the first resid hydrotreating reactor 70;

15. An inlet diluent feed line 250 connected to and communicating with the feed drum discharge line 58 for adding diluent to the influent resid oil feedstock; and 16. A feed drum-diluent injector line 252 connected to and communicating with the feed drum 56 for adding diluent directly to the feed drum.

EXAMPLES 1-21

Hydrotreated resid oil containing 1.1% by weight carbonaceous alphaltene solids was contacted and reacted with the different diluents listed in Table I. The results of Examples 1-18 were conducted and measured using the Solids at Infinite Dilution (SID) test method. In the tests, the amount of carbonaceous asphaltenic solids present was measured after the total liquid product was diluted with excess diluent at room temperature. A small sample of total liquid product was dissolved in the identified excess diluent and the solution was filtered with a 1.2 micron Millipore filter at room temperature using a small suction. Since Millipore filter paper is soluble in isopropanol and pyridine, Whatman No. 50 filter paper was used for isopropanol and pyridine diluents. At a solvent-to-total liquid product ratio of 50:1, the SID test method measures the amount of solids at an "infinite" dilution. Each SID test tool between 20 to 50 minutes. The results are shown in Table I.

TABLE I

| Tests 1-24 | | | |
|---|---|---|---|
| Test | Diluent | Ratio of Total Liquid Product (TLP) to Diluent | Weight Ratio of Diluted Solids to Undiluted Solids (percent) |
| 1 | Tetrahydrofuran (THF) | 1:Infinite | 4 |
| 2 | Hydrogenated Creosote | 1:2+ | 7 |
| 3 | Decanted Oil | 1:3+ | 7 |
| 4 | Decanted Oil | 1:0.15 | 60 |
| 5 | Decanted Oil | 1:0.10 | 80 |
| 6 | Heavy Catalytic Cycle Oil (HCCO) | 1:10 | 25 |
| 7 | Heavy Catalytic Cycle Oil (HCCO) | 1:0.25 | 60 |
| 8 | Chloroform | 1:Infinite | 10 |
| 9 | Dichloromethane | 1:Infinite | 60 |
| 10 | Xylene | 1:Infinite | 65 |
| 11 | Toluene | 1:Infinite | 67 |
| 12 | Carbon Tetrachloride | 1:Infinite | 79 |
| 13 | Pyridine | 1:Infinite | 83 |
| 14 | Ethylbenzene | 1:Infinite | 110 |
| 15 | Cyclohexane | 1:Infinite | 160 |
| 16 | Kerosene | 1:Infinite | 160 |
| 17 | Virgin Naphtha | 1:Infinite | 210 |
| 18 | Dodecane | 1:Infinite | 220 |
| 19 | n-Heptane | 1:Infinite | 250 |
| 20 | 1,1,1-Trichloroethane | 1:Infinite | 280 |
| 21 | n-Pentane | 1:Infinite | 330 |

*The term "Infinite" as used in the above table means 40 to 80 (4000% to 8000%) diluent.

Test 4 showed that the use of decanted oil, weighing 15% of the total liquid product (TLP) of resid hydrotreated oil, decreased the amount and concentration of carbonaceous asphaltenic solids by 40%. Test 5 showed that the use of decanted oil, weighing 10% of the TLP of the resid hydrotreated oil, decreased the amount and concentration of carbonaceous solids by 20%. Tests 2 and 3 showed that hydrogenated creosote comprising 200% by weight of the TLP, and decanted oil, comprising 300% by weight of the TLP, each decreased the amount and concentration of asphaltenic solids by 93%. Test 6 showed that heavy catalytic cycle oil (HCCO) weighing 1000% of the TLP, decreased the amount and concentration of carbonaceous asphaltenic solids by 75%. Test 7 showed that HCCO, weighing 25% of the TLP, decreased the amount and concentration of carbonaceous asphaltene by 40%. Tests 1 and 9-21 used at least 4000%-8000% of the indicated diluents, which is inefficient and uneconomical. Tests 14-21 caused increased precipitation of solids.

EXAMPLES 22-85

Resid oil feedstock was hydrotreated in an ebullated bed reactor at the indicated reactor temperature. In some tests no diluent was added. In other tests, the resid oil feedstock was contacted, diluted, and reacted with 10%-20% by weight of the indicated diluent and then hydrotreated in an ebullated bed reactor.

Solids formed during resid hydrotreating can be measured by the standard Shell Hot Filtration Test (SHFT) using a filtration of reactor liquid product. The Shell Hot Filtration Test is a standard method for measuring the amount of solids present in the total liquid product (TLP) at 212° F. The Shell Hot Filtration Test basically involved capturing the solids on filter paper, washing the solids with n-heptane, drying the solids, and weighing the solids. One of the advantages of the Shell Hot Filtration Test is that it does not change the chemical composition of the total liquid product.

The diluents tested were:

Decanted Oil (DCO) having a gravity of 0.6° API,

Hydrogenated Creosote having a gravity of −4.5° API,

Heavy Catalytic Cycle Oil (HCCO) having a gravity of 17.7° API,

Heavy Vacuum Gas Oil (HVGO) having a gravity of 17.8° API,

Resid Hydrotreated Gas Oil (RHUGO) having a gravity of 17.7° API, and

Coker Gas Oil (CGO) having a gravity of 21.7° API.

The results are shown in Table II.

TABLE II

Tests 22–85
SUMMARY OF CARBONACEOUS SOLIDS DATA

| Test No. | Diluent | Temperature °F. | Shell Hot Filtration Solids, Wt % of Resid Wt. Mean |
|---|---|---|---|
| 22 | None | 760 | 0.24 |
| 23 | None | 760 | 0.22 |
| 24 | None | 759 | 0.08 |
| 25 | None | 760 | 0.10 |
| 26 | None | 760 | 0.08 |
| 27 | None | 760 | 0.10 |
| 28 | None | 760 | 0.08 |
| 29 | None | 769 | 0.35 |
| 30 | None | 770 | 0.38 |
| 31 | None | 770 | 0.58 |
| 32 | None | 769 | 0.48 |
| 33 | None | 769 | 0.39 |
| 34 | None | 770 | 0.49 |
| 35 | None | 769 | 0.57 |
| 36 | None | 770 | 0.64 |
| 37 | None | 775 | 1.04 |
| 38 | None | 760 | 0.14 |
| 39 | None | 775 | 0.71 |
| 40 | None | 770 | 0.55 |
| 41 | 20% HCCO | 770 | 0.06 |
| 42 | 20% HCCO | 780 | 0.22 |
| 43 | 20% HVGO | 770 | 0.94 |
| 44 | 20% HVGO | 770 | 0.78 |
| 45 | None | 760 | 0.22 |
| 46 | None | 765 | 0.49 |
| 47 | None | 755 | 0.48 |
| 48 | None | 765 | 0.98 |
| 49 | None | 755 | 0.83 |
| 50 | None | 765 | 0.98 |
| 51 | None | 755 | 0.49 |
| 52 | None | 755 | 0.63 |
| 53 | None | 765 | 1.10 |
| 54 | 20% HCCO | 754 | 0.12 |
| 55 | 20% HCCO | 764 | 0.18 |
| 56 | 20% HCCO | 775 | 0.51 |
| 57 | 20% HCCO | 760 | 0.22 |
| 58 | 20% HCCO | 775 | 0.56 |
| 59 | 20% HCCO | 775 | 0.14 |
| 60 | 20% HCCO | 784 | 0.80 |
| 61 | 20% RHUGO | 765 | 1.07 |
| 62 | 20% RHUGO | 775 | 1.06 |
| 63 | 20% CGO | 775 | 0.80 |
| 64 | 20% CGO | 775 | 1.05 |
| 65 | 20% Creosote | 755 | 0.11 |
| 66 | 20% Creosote | 765 | 0.08 |
| 67 | 20% Creosote | 785 | 0.59 |
| 68 | 20% DCO | 765 | 0.29 |
| 69 | 20% DCO | 775 | 0.68 |
| 70 | None | 750 | 0.16 |
| 71 | None | 760 | 0.49 |
| 72 | None | 765 | 0.48 |
| 73 | None | 765 | 0.88 |
| 74 | 20% RHUGO | 765 | 0.69 |
| 75 | 20% RHUGO | 755 | 0.21 |
| 76 | 20% RHUGO | 775 | 0.54 |
| 77 | 20% RHUGO | 785 | 0.60 |
| 78 | 20% RHUGO | 795 | 0.48 |
| 79 | 20% DCO | 765 | 0.20 |
| 80 | 20% DCO | 775 | 0.40 |
| 81 | 20% DCO | 785 | 0.49 |
| 82 | 10% DCO | 765 | 0.37 |
| 83 | 10% DCO | 775 | 0.43 |
| 84 | 10% DCO | 775 | 0.47 |
| 85 | 10% DCO | 785 | 0.77 |

Tests 22–85 indicated that heavy catalytic cycle oil, decanted oil (HCCO), and hydrogenated creosote, reduced solids yields by almost 50%. RHU gas oil, coker gas oil, and heavy vacuum gas oil (HVGO) reduced solids concentrations by the indicated amount.

The diluents increased reaction rates for Rams carbon conversion, asphaltene conversion, desulfurization, and vanadium removal by 10% to 30%. The diluents also reduced the size of the solids.

Hydrogen consumption by the diluents ranged from 500 to 1,900 SCFB. The yields of light gas, distillates, and naphtha increased as some of the diluent was converted to lighter products in the ebullated bed reactor.

When the amount of carbonaceous asphaltenic solids measured less than 0.5 wt %, the operability of the resid hydrotreating unit and the downstream refining equipment were not substantially affected by the presence of the small amount of carbonaceous solids. When the amount of carbonaceous asphaltenic solids rose above 1% to 2% by weight, operation of the resid hydrotreating unit and the downstream equipment was seriously impaired and usually required shutdown within three working days. When the amount of carbonaceous solids in the product hydrotreated oil was 0.5% by weight or more, operation of the resid hydrotreating unit and the downstream refining equipment became more difficult and less effective with greater amounts of carbonaceous solids.

Among the many advantages of the novel process for reducing resid hydrotreating solids are:

1. Significant decreases of carbonaceous asphaltenic solids in the product oil.
2. Superior process efficiency.
3. Improved process effectiveness.
4. Lower operating and maintenance costs.
5. Reduced downtime.
6. Increased product yield.
7. Better product quality.
8. Enhanced operability.
9. Increased resid conversion.
10. Enhanced feed flexibility.
11. Improved the fuel quality of the resid.

Although embodiments of this invention have been shown and described, it is to be understood that various modifications and substitutions, as well as rearrangements and combinations of process steps and equipment, can be made by those skilled in the art without departing from the novel spirit and scope of this invention.

What is claimed is:

1. A hydrotreating process, comprising the steps of:

feeding a feedstock comprising oil to at least one ebullated bed hydrotreater;

injecting hydrogen-rich gases to said ebullated bed hydrotreater;

hydrotreating said feedstock by contacting and ebullating said feedstock with said hydrogen-rich gases in said ebullated bed hydrotreater in the presence of a hydrotreating catalyst under hydrotreating conditions to produce hydrotreated oil;

feeding said hydrotreated oil to a fractionator selected form the group consisting of an atmospheric tower, a vacuum tower, and combinations thereof;

contacting said hydrotreated oil with a diluent comprising decanted oil by injecting and dispersing said diluent comprising decanted oil into said hydrotreated oil in said fractionator for substantially minimizing precipitation of asphaltenic solids in said fractionator; and fractionating said hydrotreated oil in said fractionator after contacting said hydrotreated oil with said diluent comprising decanted oil.

2. A hydrotreating process, comprising the steps of:

feeding hydrogen-rich gases and a feedstock comprising a resid oil to a reactor train comprising a series of three ebullated bed reactors;

conveying a hydrotreating catalyst to said reactor train;

ebullating said hydrogen-rich gases and resid oil together in the presence of said hydrotreating catalyst in said ebullated bed reactors to produce hydrotreated oil containing asphaltenic solids;

conveying said hydrotreated oil to a separator;

separating said hydrotreated oil in said separator into a low solid stream of light hydrotreated oil containing a lesser concentration of said asphaltenic solids than said influent conveyed hydrotreated oil, and a solids-enriched stream of heavy hydrotreated oil containing a greater concentration of said asphaltenic solids than said influent conveyed hydrotreated oil;

decreasing the pressure of said solids-enriched stream;

conveying said solids-enriched decreased pressure stream to fractionators comprising an atmospheric tower and a vacuum tower;

separating said solids-enriched stream in said atmospheric tower into at least one atmospheric stream of distillate, an atmospheric stream of gas oil, and an effluent stream of atmospheric resid oil containing a greater concentration of said asphaltenic solids than said solids-enriched stream;

conveying said atmospheric resid oil to said vacuum tower;

separating said atmospheric resid oil in said vacuum tower into at least one vacuum stream of gas oil and a bottom stream of vacuum resid oil; and reducing the precipitation of asphaltenic solids in said fractionators and concurrently decreasing the concentration of asphaltenic solids in the resid oil discharged from said fractionators by injecting decanted oil into at least one of said fractionators.

3. A hydrotreating process in accordance with claim 2 wherein said decanted oil is added to said atmospheric tower.

4. A hydrotreating process in accordance with claim 2 wherein said decanted oil is fed into said vacuum tower.

5. A hydrotreating process in accordance with claim 2 wherein said decanted oil is injected into said atmospheric tower and said vacuum tower.

6. A hydrotreating process in accordance with claim 2 wherein said decanted oil has an API gravity ranging from about −5° API to about +10° API and said decanted oil ranged from 5% to less than 20% by weight of said resid oil.

7. A hydrotreating process in accordance with claim 6 wherein said decanted oil ranges from about 7% to about 12% by weight of said resid oil.

8. A hydrotreating process in accordance with claim 7 including simultaneously increasing said production of hydrotreated oil in said ebullated bed reactors and decreasing the amount of said hydrogen-rich gases fed to said ebullated bed reactors while injecting said decanted oil into said tower.

* * * * *

UNITED STATES PATENT OFFICE

CERTIFICATE OF CORRECTION

Patent No. 4,808,298 Dated February 28, 1989

Inventor(s) LAWRENCE B. PECK, ROBERT D. BUTTKE, GEORGE L. OTT, and JEFFRY A. COX

It is certified that error appears in the above-identified patent and that said Letters Patent is hereby corrected as shown below:

| Column | Line | |
|---|---|---|
| 1 | 9 | "Buffke" should read --Buttke-- |
| 1 | 53 | "Alphaltenic" should read --Asphaltenic-- |
| 2 | 9 | "Reside" should read --resid-- |
| 3 | 4 | "economical" should read --economic-- |
| 3 | 6 | "reside" should read --resid-- |
| 4 | 5 | "over head" should read --overhead-- |
| 4 | 18 | "which" should read --where-- |
| 5 | 24 | "catalyst" should read --catalysts-- |
| 6 | 42 | "85" should read --8%-- |
| 6 | 65 | "unit.l" should read --unit.-- |
| 6 | 68 | "spend" should read --spent-- |
| 7 | 1 | "catalystic" should read --catalytic-- |
| 7 | 46 | "towerinlet" should read --tower-inlet-- |
| 9 | 4 | "catalystically" should read --catalytically-- |
| 9 | 46 | "ine" should read --line-- |

UNITED STATES PATENT OFFICE
CERTIFICATE OF CORRECTION

Patent No. 4,808,298 Dated February 28, 1989

Inventor(s) LAWRENCE B. PECK, ROBERT D. BUTTKE, GEORGE L. OTT, and JEFFRY A. COX

It is certified that error appears in the above-identified patent and that said Letters Patent is hereby corrected as shown below:

| Column | Line | |
|---|---|---|
| 10 | 15 | "disadvantages" should read --advantages-- |
| 11 | 10 | "injection" should read --injecting-- |
| 11 | 38 | "alphaltene" should read --asphaltene-- |
| 11 | 40 | "results" should read --tests-- |
| 11 | 53 | "tool" should read --took-- |
| 16 | 21 | "ranged" should read --ranges-- |

Signed and Sealed this

Seventh Day of August, 1990

*Attest:*

*Attesting Officer*

HARRY F. MANBECK, JR.

*Commissioner of Patents and Trademarks*